US012752887B2

(12) United States Patent
Janda

(10) Patent No.: US 12,752,887 B2
(45) Date of Patent: Oct. 6, 2026

(54) SURFBOARD LEASH

(71) Applicant: CI Surfboards, LLC, Carpinteria, CA (US)

(72) Inventor: Todd Janda, New Smyrna Beach, FL (US)

(73) Assignee: CI Surfboards, LLC, Carpinteria, CA (US)

( * ) Notice: Subject to any disclaimer, the term of this patent is extended or adjusted under 35 U.S.C. 154(b) by 348 days.

(21) Appl. No.: 18/413,576

(22) Filed: Jan. 16, 2024

(65) Prior Publication Data

US 2024/0239449 A1 Jul. 18, 2024

Related U.S. Application Data

(60) Provisional application No. 63/439,484, filed on Jan. 17, 2023.

(51) Int. Cl.
*B63B 32/73* (2020.01)

(52) U.S. Cl.
CPC ..... *B63B 32/73* (2020.02)

(58) Field of Classification Search
CPC ..... B63B 32/00; B63B 32/40; B63B 32/45; B63B 32/70; B63B 32/73
USPC ..... 114/65, 74, 75
See application file for complete search history.

(56) References Cited

U.S. PATENT DOCUMENTS 4,610,634 A 9/1986 Kimura
5,775,965 A * 7/1998 Hango ..... B63B 32/70 441/74
5,957,741 A * 9/1999 Evans ..... B63B 32/73 441/75
7,204,734 B2 4/2007 Kawasaki
7,918,699 B2 4/2011 Malloy
8,292,682 B2 * 10/2012 Buche ..... B63B 32/40 441/75
8,894,457 B1 * 11/2014 Crozier ..... B63B 32/70 441/75
9,248,891 B2 * 2/2016 Falken ..... B63B 32/73
9,580,154 B2 * 2/2017 Falken ..... B63B 32/73
9,821,891 B2 * 11/2017 Falken ..... B63B 32/73
10,046,839 B2 * 8/2018 Falken ..... B63B 32/73
10,336,416 B2 * 7/2019 Henderson ..... B63B 32/73
D888,859 S 6/2020 West et al.
D888,860 S 6/2020 West et al.
10,737,750 B2 * 8/2020 Lundstedt, Jr. ..... B63B 32/73
D921,802 S 6/2021 West et al.
11,273,888 B2 * 3/2022 West ..... B63B 32/73
2002/0090870 A1 7/2002 Kerckhoff
(Continued)

FOREIGN PATENT DOCUMENTS

AU 656039 B2 1/1995
AU 2011101350 A4 11/2011
(Continued)

*Primary Examiner* — Daniel V Venne
(74) *Attorney, Agent, or Firm* — Merchant & Gould P.C.

(57) ABSTRACT

A surfboard leash, including a cord having a first durometer hardness, a connector having a second durometer hardness molded over an end of the cord, and a flex ring having a third durometer hardness positioned a least partially around the cord and at least partially between the cord and the connector, wherein the third shore durometer is less than first shore durometer and the second shore durometer.

20 Claims, 5 Drawing Sheets

(56) References Cited

U.S. PATENT DOCUMENTS

| | | | |
|---|---|---|---|
| 2007/0284427 | A1 | 12/2007 | Patton |
| 2012/0244763 | A1 | 9/2012 | Cregan |
| 2015/0298776 | A1 | 10/2015 | Lowell |
| 2016/0152308 | A1 | 6/2016 | Falken |
| 2016/0185302 | A1 | 6/2016 | Caslowitz |
| 2020/0269958 | A1 | 8/2020 | West et al. |

FOREIGN PATENT DOCUMENTS

| | | | |
|---|---|---|---|
| AU | 2007226812 | B2 | 6/2012 |
| AU | 2012244241 | A1 | 11/2013 |
| CN | 215971998 | U | 3/2022 |
| GB | 2565847 | B | 7/2019 |
| KR | 101179061 | B1 | 8/2012 |
| KR | 101955006 | B1 | 3/2019 |
| TW | 201120333 | A | 6/2011 |
| WO | 2011045821 | A1 | 4/2011 |
| WO | 2016010929 | A1 | 1/2016 |
| WO | 2017181225 | A1 | 10/2017 |
| WO | 2018048301 | A1 | 3/2018 |
| WO | 2020176688 | A1 | 9/2020 |
| WO | 2022104407 | A1 | 5/2022 |

* cited by examiner

SURFBOARD LEASH

CROSS-REFERENCE TO RELATED APPLICATION

This application claims the benefit of U.S. Provisional Application No. 63/439,484, filed Jan. 17, 2023, titled "SURFBOARD LEASH," the disclosure of which is hereby incorporated herein by reference.

TECHNICAL FIELD

The present disclosure relates to generally to sports equipment related to surfing, and more particularly to improvements in surfboard leashes.

BACKGROUND

A surfboard leash or leg rope is used in surfing to couple the surfboard to the leg of a surfer, to prevent the surfboard from being swept away by waves and stop runaway surfboards from hitting other surfers and swimmers in the event that the surfer falls from the board. Most surfboard leashes include a cuff, swivel, cord, and rail saver.

The rail saver includes a portion of fabric that attaches the cord to the surfboard by a suitable anchor arrangement, often near a rear end of the board. The rail saver functions to provide a secure connection between the cord and the surfboard while protecting the relatively soft rail of the surfboard from damage by the cord when the cord is drawn taut.

The cuff typically includes a strap having a hook and loop fastener adapted to be wrapped around the ankle or calf of a surfer. The cuff functions to provide a secure connection between the leg of the user and the cord. The swivel is positioned between the cuff and the cord to enable the cord to spin and twist relative to the cuff to inhibit tangling; although the swivel can also be positioned between the cord and the rail saver.

Prior to the introduction of surfing leashes in 1971, surfers who fell off their boards had to swim to retrieve their board, with runaway boards being a potential danger to other surfers. Recognizing that the surfboard leashes had to have some capacity for resilient longitudinal extension to dampen out the tensile shock on the ankle of the user as the cord is rapidly drawn taut, initial surf leash designs used surgical cords. Unfortunately the surgical cords proved to be too elastic, causing the surfboard to fly back towards the surfer.

Modern surfboard leash cords are typically made from a high quality polyurethane, which represents a balance between dampening tensile shock and inhibiting excessive spring back. Although such cords work well for their intended purpose, the cords eventually wear out and break. One area of high stress concentration occurs near the end of the cord at the connection to the cuff/swivel. Many times a breakage occurs at or near this connection point.

The present disclosure addresses this concern.

SUMMARY

Aspects of the present disclosure relate to a surfboard leash including a flexible ring (occasionally referred to herein as a "flex ring") positioned between the cord and an overmolded swivel connector positioned at an end of the cord, the flexible ring having the effect of dispersing tensile loads experienced by the cord as the cord is bent into tight curves at the connection point during use. The flex ring generally being constructed of a softer, more resilient, less stiff material than the cord and the overmolded swivel connector, thereby having the effect of reducing wear at the connection point near the end of the cord.

One aspect of the present disclosure provides a surfboard leash configured to provide a connection between a surfboard and a leg of a user, including a rail saver attachable to the surfboard, a cuff attachable to the leg of a user, a cord extending between a first end and a second end and having a first durometer hardness enabling the cord to be resiliently extendable in length, a swivel operably coupling the cord to the cuff, the swivel operably coupled to the cord by a swivel connector having a second durometer hardness molded over a portion of the swivel and the first end of the cord, and a flex ring having a third durometer hardness positioned around the cord and at least partially between the cord and the connector, wherein the third shore durometer is less than the first shore durometer and the second shore durometer.

In one embodiment, the cord and the swivel connector are constructed of urethane. In one embodiment, the cord and the swivel connector have a durometer hardness of about 90 A. In one embodiment, the flex ring is constructed of silicone. In one embodiment, the flex ring has a durometer hardness of less than 90 A.

Another aspect of the present disclosure provides a cord for surfboard leash, including a cord having a length extending between a first end and a second end, the cord having a first durometer hardness enabling the length of the cord to be resiliently extendable, a connector having a second durometer hardness molded over the first end of the cord, and a flex ring having a third durometer hardness positioned around the cord and at least partially between the cord and the connector, wherein the third shore durometer is less than first shore durometer and the second shore durometer.

In one embodiment, the cord and the connector are constructed of urethane. In one embodiment, the first hardness and the second hardness are substantially equal. In one embodiment, the cord and the connector have a durometer hardness of about 90 A. In one embodiment, the flex ring is constructed of silicone. In one embodiment, the flex ring is has a durometer hardness of less than 90 A. In one embodiment, the cord further includes swivel operably coupled to the connector. In one embodiment, the flex ring comprises a tubular wall extending between a first end and a second end, with an apex representing a maximum thickness of the tubular wall positioned between the first end and the second end. In one embodiment, the tubular wall decreases in thickness between the apex and the second end. In one embodiment, the flex ring comprises a first portion layered between the cord and the connector, and a second portion extending away from an end of the connector.

Another aspect of the present disclosure provides a surfboard leash, including a cord having a first durometer hardness, a connector having a second durometer hardness molded over an end of the cord, and a flex ring having a third durometer hardness positioned a least partially around the cord and at least partially between the cord and the connector, wherein the third shore durometer is less than first shore durometer and the second shore durometer.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
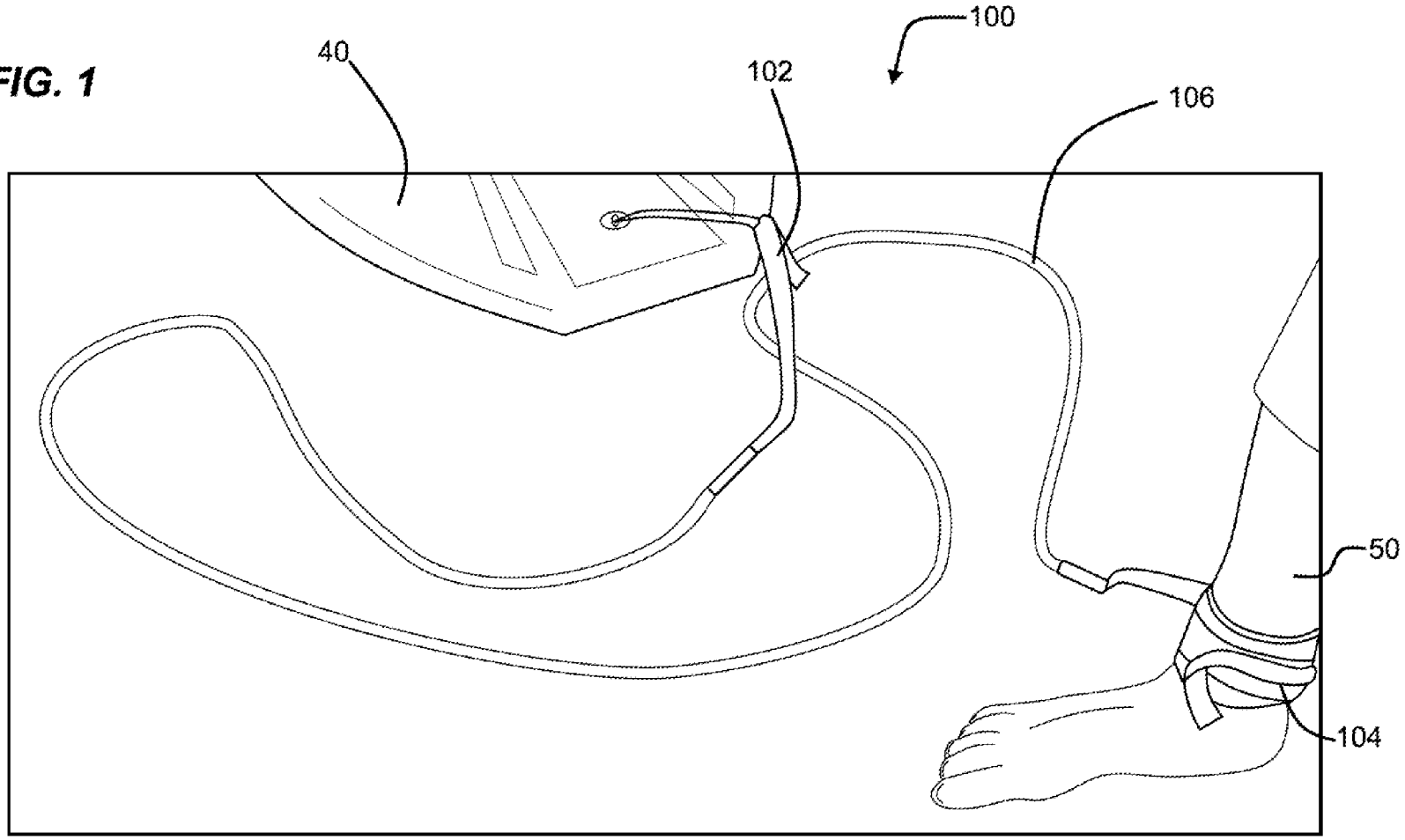
FIG. 1 is a perspective view depicting a surfboard leash, in accordance with an embodiment of the disclosure.

Referring to FIG. 1, a surfboard leash 100 is depicted in accordance with an embodiment of the disclosure. As depicted, the surfboard leash 100 is configured to provide a secure connection between a surfboard 40 and a leg of a user 50. In embodiments, the surfboard leash 100 includes a rail saver 102 attachable to the surfboard 40, a cuff 104 attachable to the leg of the user 50, and a cord 106 operably coupling the rail saver 102 to the cuff 104. In embodiments, the cord 106 can be constructed of a resilient material having a first durometer hardness enabling the cord 106 to be resiliently extendable in length having the effect of dampening tensile shock, while inhibiting excessive spring back during use. Accordingly, should the user 50 fall while riding a wave, the surfboard 40 will not be swept away from the user 50, thus allowing the user 50 to quickly recover the surfboard 40 and return to the takeoff zone.

Figure 2:
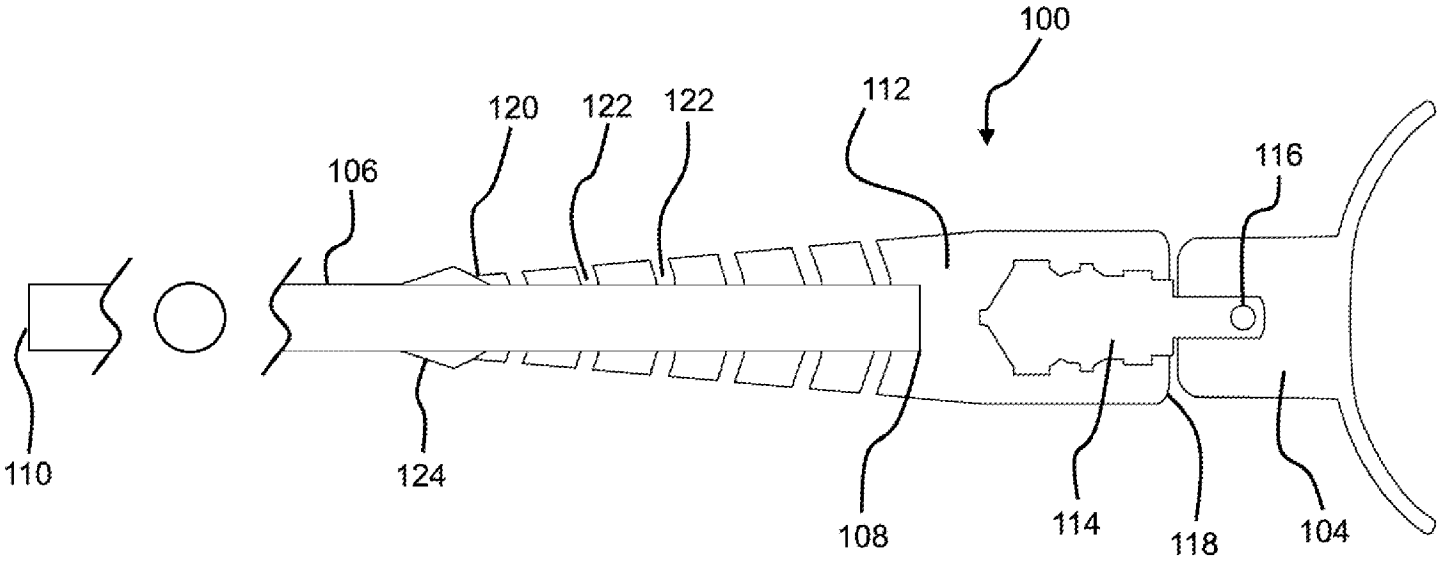
FIG. 2 is a plan view depicting a connection between a cord and a cuff, in accordance with an embodiment of the disclosure.
Figure 3:
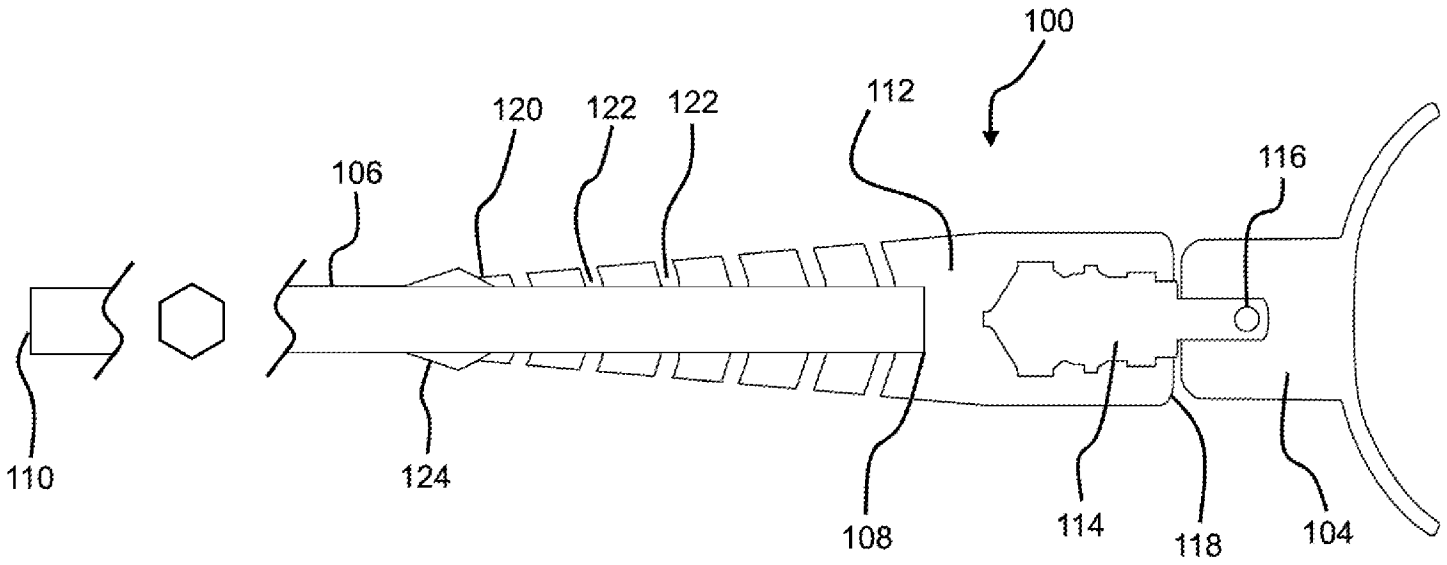
FIG. 3 is a plan view depicting a connection between a cord and a cuff, wherein the cord has a polygon cross-section, in accordance with an embodiment of the disclosure.

As further depicted in FIGS. 2 and 3 the cord 106 can extend between a first end 108 and a second end 110. In some embodiments, the cord 106 can have a substantially circular cross-section (e.g., such as that depicted in FIG. 2). In other embodiments, the cord 106 can have other cross-sectional shapes, such as a hexagon (e.g., such as that depicted in FIG. 3). Additionally, in some embodiments, the cord 106 can be constructed to have a range of thicknesses or diameters for desired drag and tensile strength usage. In one non-limiting example, the cord 106 can be constructed to have a cross-sectional thickness or diameter of about 5.5 mm, wherein the term "about" or "substantially" as used throughout this disclosure means±5% of the referenced value(s).

As discussed above, one area of high stress concentration in the cord 106 occurs at or near a connection point between the cord 106 and a swivel connector 112, which operably couples the first end 108 of the cord 106 to the swivel 114. As further depicted in FIGS. 2 and 3, the swivel 114 is secured to the cuff 104 (e.g., via a fastener 116, etc.), thereby pivotably coupling the cuff 104 to the cord 106. In particular, the swivel connector 112 can be molded over the first end 108 of the cord 106 to encompass a portion of the cord 106 in proximity to the first end 108.

In construction of the swivel connector 112, a clamshell mold can be positioned over the first end 108 of the cord 106, with a portion of the swivel 114 positioned within the clam shell mold. Material comprising the swivel connector 112 can then be introduced into the clamshell mold at a desired temperature and pressure, such that as the material cures, the swivel connector 112 is formed in which a portion of the cord 106 and swivel 114 are embedded. In embodiments, the swivel connector 112 can extend between a first end 118 from which the swivel 114 extends, and a second end 120 from which the cord 106 extends.

In some embodiments, the swivel connector 112 can have a first cross-sectional area at the first end 118, and a second cross-sectional area at the second end 120, wherein the first cross-sectional area is larger than the second cross-sectional area. For example, in some embodiments, the swivel connector 112 can generally taper or reduce in diameter or cross-sectional thickness from the first end 118 to the second end 120, which in turn reduces a stiffness of the swivel connector 112 approaching the second end 120 of the swivel connector 112, which in turn has the effect of inhibiting the occurrence of tight radius bends in the cord 106 in proximity to the second and 120 of the swivel connector 112. To further reduce a stiffness in the swivel connector 112, in some embodiments, one or more apertures 122 can be defined in the swivel connector 112.

Despite efforts to reduce stiffness in the swivel connector 112 in proximity to the connection to the cord 106, experience shows that breakages in the cord 106 tend to occur in close proximity to the connection between the swivel connector 112 and the cord 106. In particular, during use, tight curves or bends tend to occur in the cord 106 where the cord 106 meets the swivel connector 112. When a load is applied, material on the outer radius of the curve or bend tends to carry a majority of the load, which can lead to the material being overloaded and failing. The failure can propagate through the material to the inner radius as the load is carried by the remaining material.

To address this concern, applicants of the present disclosure have developed a flexible ring 124 positioned at the second end 120 of the swivel connector 112, between at least a portion of the of the swivel connector 112 and the cord 106. For example, in in some embodiments, the flex ring 124 can be in the form of a hollow tube or loop which can be positioned over a first end 108 of the cord 106, such that the swivel connector 112 is molded over at least a portion of the flex ring 124. In operation, the flex ring can have the effect of increasing the flexibility of the second end 120 of the swivel connector 112, which in turn has the effect of decreasing concentrations of stress in tight bends in the cord 106 that tend to occur at the connection between the cord 106 and the swivel connector 112.

In some embodiments, the cord 106 can be constructed of an extruded polyurethane material, having a first shore hardness durometer of between about 70 A and about 95 A. In embodiments, the swivel connector 112 can also be constructed of a polyurethane material, having a second shore hardness durometer, which can be similar to the first shore hardness (e.g., the second shore hardness durometer can have a value of between about 65 A and about 100 A). In other embodiments, the shore hardness durometer of the swivel connector 112 can be different than the shore hardness durometer of the cord 106.

In some embodiments, the flex ring 124 can be constructed of silicone, having a third shore hardness durometer, which can be less than both the first shore hardness durometer and the second shore hardness durometer. For example, in one embodiment, the flex ring 124 can have a shore hardness durometer of between about 20 A and about 80 A), such that the material used to construct the flex ring 124 is generally less hard than the materials used to construct the cord 106 and swivel connector 112.

Figure 4:
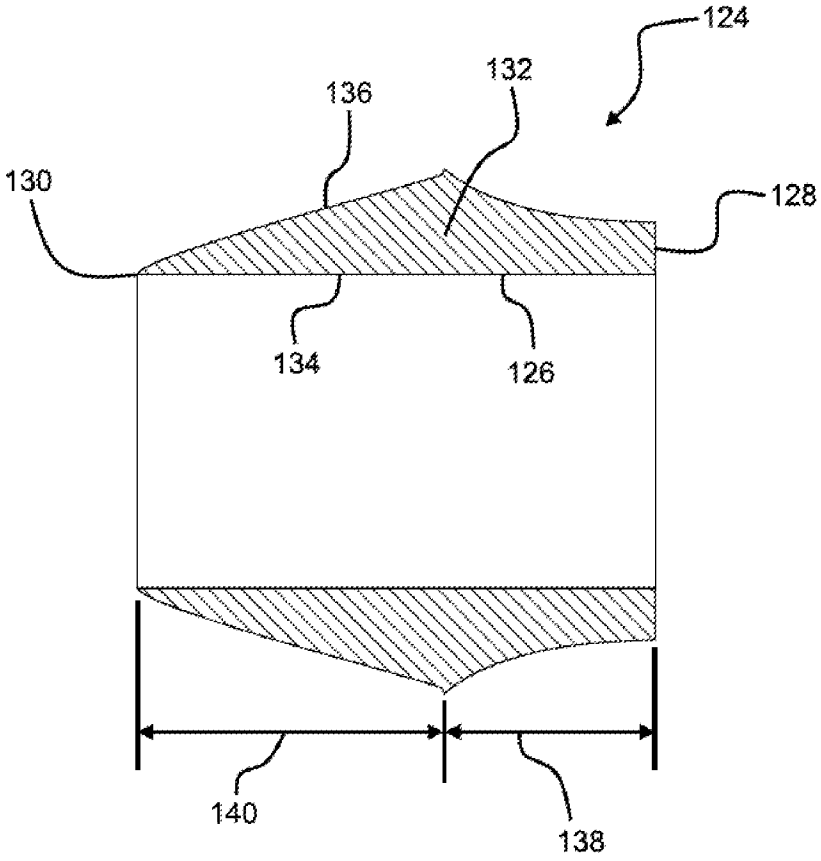
FIG. 4 is a cross-sectional view depicting a flex ring, in accordance with an embodiment of the disclosure.
Figure 5:
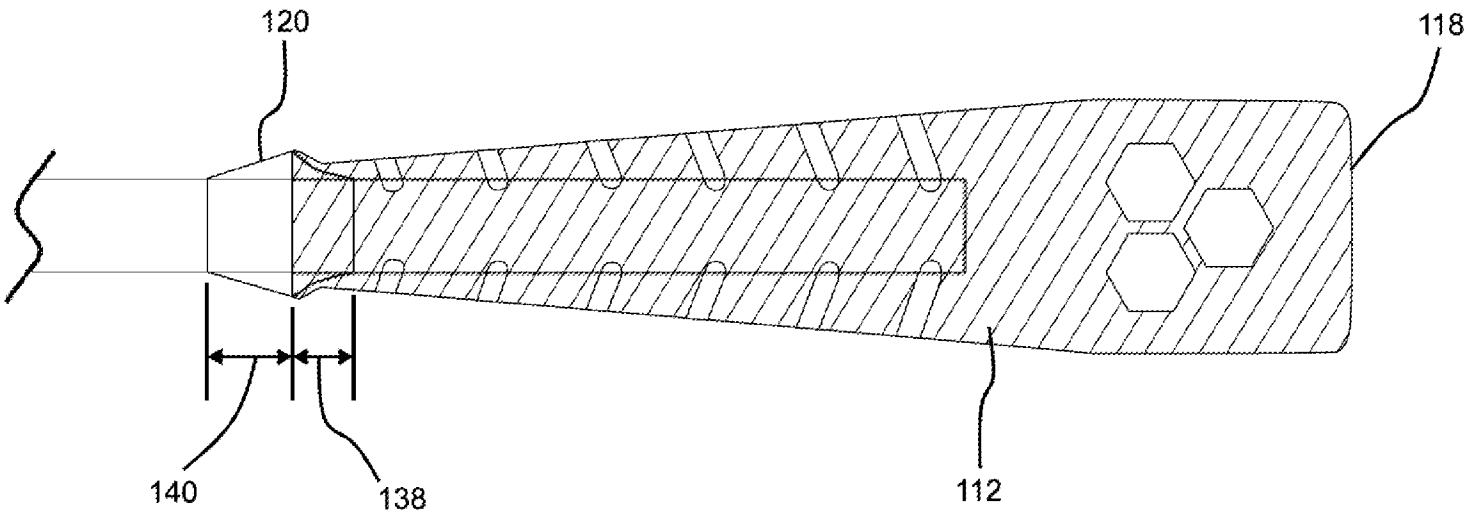
FIG. 5 is a plan view depicting a swivel connector molded over a portion of a flex ring, in accordance with an embodiment of the disclosure.

As further depicted in FIG. 4, in some embodiments, the flex ring 124 can include a tubular wall 126 that extends between a first end 128 and a second end 130. In some embodiments, the flex ring 124 can include an apex 132 positioned between the first end 128 and the second end 130, representing a maximum thickness of the tubular wall 126. In embodiments, the tubular wall 126 can decrease in thickness when moving from the apex 132 to the second and 130, which can have the effect of decreasing the stiffness of the flex ring 124 over the length of the flex ring 124 between the apex 132 and the second end 130. For example, in some embodiments, while the interior surface 134 of the tubular wall 126 is conformed to fit over the cord 106, the exterior surface 136 of the tubular wall 126 can generally taper away from the apex 132 to a minimum diameter in proximity to the second end 130.

In some embodiments, the flex ring 124 can define a first portion 138 extending between the apex 132 and the first end 128, and a second portion 140 extending between the apex 132 and the second end 130. In embodiments, the first portion 138 can be positioned as a layer between the swivel connector 112 and the cord 106, which can have the effect of acting as an elastic shock absorber between the swivel connector 112 and the cord 106.

Accordingly, in some embodiments, the swivel connector 112 is at least partially molded over a portion of the flex ring 124, which can have the effect of adhering the swivel connector 112, flex ring 124 and cord 106 together at the first portion 138. For example, in one embodiment, the first portion 138 can be adherently bonded through the overmolding process to at least the swivel connector 112, and optionally the cord 106. The second portion 140 can be configured to extend from the second end 120 of the swivel connector 112, thereby acting as an extension of the swivel connector 112 surrounding the cord 106.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A surfboard leash configured to provide a connection between a surfboard and a leg of a user, the surfboard leash comprising:

a rail saver attachable to the surfboard;

a cuff attachable to the leg of a user;

a cord extending between a first end and a second end and having a first shore durometer hardness enabling the cord to be resiliently extendable in length;

a swivel operably coupling the cord to the cuff, the swivel operably coupled to the cord by a swivel connector having a second shore durometer hardness and molded over a portion of the swivel and the first end of the cord; and a flex ring having a third durometer hardness and positioned around the cord and at least partially between the cord and the connector, wherein the third shore durometer hardness is less than the first shore durometer hardness and the second shore durometer hardness.

2. The surfboard leash of claim 1, wherein the cord and the swivel connector are constructed of urethane.

3. The surfboard leash of claim 1, wherein the cord and the swivel connector have a durometer hardness of about 90 A.

4. The surfboard leash of claim 1, wherein the flex ring is constructed of silicone.

5. The surfboard leash of claim 1, wherein the flex ring has a shore durometer hardness of less than 90 A.

6. A cord for a surfboard leash, comprising:

a cord having a length extending between a first end and a second end, the cord having a first shore durometer hardness enabling the length of the cord to be resiliently extendable;

a connector having a second shore durometer hardness and molded over the first end of the cord; and a flex ring having a third shore durometer hardness and positioned around the cord and at least partially between the cord and the connector, wherein the third shore durometer hardness is less than the first shore durometer hardness and the second shore durometer hardness.

7. The cord of claim 6, wherein the cord and the connector are constructed of urethane.

8. The cord of claim 6, wherein the first shore durometer hardness and the second shore durometer hardness are substantially equal.

9. The cord of claim 6, wherein the cord and the connector have a shore durometer hardness of about 90 A.

10. The cord of claim 6, wherein the flex ring is constructed of silicone.

11. The cord of claim 6, wherein the flex ring has a shore durometer hardness of less than 90 A.

12. The cord of claim 6, further comprising a swivel operably coupled to the connector.

13. The cord of claim 6, wherein the flex ring comprises a tubular wall extending between a first end and a second end, with an apex representing a maximum thickness of the tubular wall positioned between the first end and the second end.

14. The cord of claim 13, wherein the tubular wall decreases in thickness between the apex and the second end.

15. The cord of claim 6, wherein the flex ring comprises a first portion layered between the cord and the connector, and a second portion extending away from an end of the connector.

16. A surfboard leash, comprising:

a cord having a first shore durometer hardness;

a connector having a second shore durometer hardness and molded over an end of the cord; and a flex ring having a third shore durometer hardness and positioned at least partially around the cord and at least partially between the cord and the connector, wherein the third shore durometer hardness is less than the first shore durometer hardness and the second shore durometer hardness.

17. The surfboard leash of claim 16, wherein the cord and the connector are constructed of urethane.

18. The surfboard leash of claim 16, wherein the cord and the connector have a shore durometer hardness of about 90 A.

19. The surfboard leash of claim 16, wherein the flex ring is constructed of silicone.

20. The surfboard leash of claim 16, wherein the flex ring has a shore durometer hardness of less than 90 A.

* * * * *